US007134201B2

(12) United States Patent
Ackerman et al.

(10) Patent No.: US 7,134,201 B2
(45) Date of Patent: Nov. 14, 2006

(54) WINDOW PANE AND A METHOD OF BONDING A CONNECTOR TO THE WINDOW PANE

(75) Inventors: Mark S. Ackerman, Brooklyn, MI (US); Timothy P. Hoepfner, Grand Lodge, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 0 days.

(21) Appl. No.: 10/987,469

(22) Filed: Nov. 12, 2004

(65) Prior Publication Data

US 2006/0105589 A1 May 18, 2006

(51) Int. Cl.
*H01R 43/00* (2006.01)

(52) U.S. Cl. ..... 29/857; 29/825; 29/842; 29/846; 219/203

(58) Field of Classification Search ..... 29/825, 29/842, 846, 857, 847; 219/203
See application file for complete search history.

(56) References Cited

U.S. PATENT DOCUMENTS

| | | | | |
|---|---|---|---|---|
| 3,324,543 | A | 6/1967 | McVey et al. | 29/472.9 |
| 3,657,802 | A | 4/1972 | Delmas | 29/472.9 |
| 3,736,649 | A | 6/1973 | Bristow | 29/473.1 |
| 3,795,041 | A | 3/1974 | Hennicke et al. | 29/472.9 |
| 3,926,357 | A | 12/1975 | Matrisian | 228/110 |
| 4,024,613 | A | 5/1977 | Martel et al. | 29/25.13 |
| 4,546,409 | A | 10/1985 | Yoshino et al. | 361/387 |
| 4,589,584 | A | 5/1986 | Christiansen et al. | 228/110 |
| 4,707,591 | A | 11/1987 | Sprenger | 219/541 |
| 4,763,828 | A | 8/1988 | Fukaya et al. | 228/124 |
| 4,918,288 | A * | 4/1990 | Carter et al. | 219/203 |
| 4,925,607 | A | 5/1990 | Kyle | 264/60 |
| 4,935,583 | A | 6/1990 | Kyle | 174/152 |
| 5,013,612 | A | 5/1991 | Hunt et al. | 428/552 |
| 5,058,800 | A | 10/1991 | Yoshizawa et al. | 228/180.2 |
| 5,134,248 | A | 7/1992 | Kiec et al. | 174/84 R |
| 5,198,056 | A | 3/1993 | Stöckli et al. | 156/73.1 |
| 5,270,517 | A | 12/1993 | Finley | 219/203 |
| 5,288,006 | A | 2/1994 | Otsuka et al. | 228/111 |
| 5,354,392 | A | 10/1994 | Santo et al. | 156/73.1 |
| 5,454,506 | A | 10/1995 | Jordhamo et al. | 228/110.1 |
| 5,735,446 | A | 4/1998 | White et al. | 228/114.5 |
| 5,738,270 | A | 4/1998 | Malmgren | 228/193 |

(Continued)

FOREIGN PATENT DOCUMENTS

| | | |
|---|---|---|
| DE | 3604437 | 8/1987 |

(Continued)

OTHER PUBLICATIONS

A subtle technique for building components Electronica Oggi No. 10 p. 73-74, 76 Oct. 1980 Country of publication: Italy.*

(Continued)

*Primary Examiner*—Carl J. Arbes
(74) *Attorney, Agent, or Firm*—Howard & Howard Attorneys, P.C.

(57) ABSTRACT

A method of bonding a connector to an electrical conductor. The conductor is applied to a glass substrate and the connector is placed over the conductor. An ultrasonic welding apparatus is used to oscillate the connector relative to the conductor to bond the connector to the conductor while maintaining the temperatures of the connector and conductor below the predefined melting points and without damaging the glass substrate. In addition, an electrically conductive foil can be disposed between the connector and the conductor for ensuring electrical communication between the connector and the conductor.

28 Claims, 9 Drawing Sheets

U.S. PATENT DOCUMENTS

| | | | | |
|---|---|---|---|---|
| 5,738,554 | A | 4/1998 | Borger et al. | 439/874 |
| 5,768,457 | A * | 6/1998 | Narayanan et al. | 385/50 |
| 5,798,031 | A | 8/1998 | Charlton et al. | 204/403 |
| 5,845,836 | A | 12/1998 | White et al. | 228/56.3 |
| 5,857,259 | A | 1/1999 | Johnston | 29/858 |
| 5,867,128 | A | 2/1999 | Sauer | 343/713 |
| 5,897,964 | A | 4/1999 | White et al. | 428/630 |
| 6,039,238 | A | 3/2000 | Panaghe et al. | 228/110.1 |
| 6,103,034 | A | 8/2000 | Fijiwara et al. | 153/73.1 |
| 6,103,998 | A | 8/2000 | Kuno et al. | 219/203 |
| 6,103,999 | A | 8/2000 | Nishio et al. | 219/203 |
| 6,123,588 | A | 9/2000 | Johnston | 439/876 |
| 6,135,829 | A | 10/2000 | Johnston | 439/874 |
| 6,217,373 | B1 | 4/2001 | Johnston | 439/499 |
| 6,307,515 | B1 | 10/2001 | Sauer et al. | 343/713 |
| 6,396,026 | B1 | 5/2002 | Gillner et al. | 219/203 |
| 6,472,636 | B1 * | 10/2002 | Baldwin | 219/203 |
| 6,528,769 | B1 | 3/2003 | Schnabel et al. | 219/446.1 |
| 6,534,720 | B1 | 3/2003 | Von Alpen et al. | 174/149 |
| 6,834,969 | B1 * | 12/2004 | Bade et al. | 359/507 |
| 2001/0030185 | A1 | 10/2001 | Schnabel et al. | 219/446.1 |
| 2003/0121906 | A1 | 7/2003 | Abbott et al. | 219/543 |
| 2003/0155467 | A1 | 8/2003 | Petrenko | 244/134 |

FOREIGN PATENT DOCUMENTS

| | | |
|---|---|---|
| DE | 19536131 | 1/1997 |
| JP | 62172676 | 7/1987 |

OTHER PUBLICATIONS

Author Unknown, "Welding of Titanium Alloys", www.key-to-metals.com printed Jun. 23, 2004, pp. 1-4, Copyright 2000-2003 INI International. Distribution for Step-Commerce AG, Spiegelhofstrasse 26, Zurich Switzerland.

Publication entitled *"Future of Heatable Automotive Glazing Conductive Pastes"*, reprinted from Screenprinting & Decorating—Stars of the 'Silver' Screen Automotive Glass; from International Glass Review, published in 2001—Issue 2, pp. 117-122, by Arthur Bechtloff, Product Manager Conductive Pastes, dmc2, Glass Systems Division, of Gutleutstrasse 215, D-60039 Frankfurt, Germany.

Publication entitled *"Tarnishing-resistant Lead-free Silver Paste for Automotive Backlights"*, www.glassfiles.com reprinted from Glass Processing Days, pp. 18-21, Jun. 2001, by Ronald Billing and Detlef Rehorek of Johnson Matthey Glass.

U.S. Appl. No. 10/988,350, filed Nov. 12, 2004.

* cited by examiner

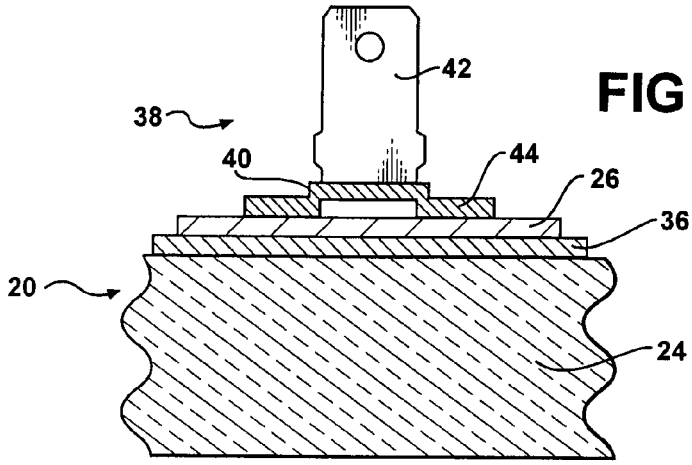
FIG - 7
FIG - 8
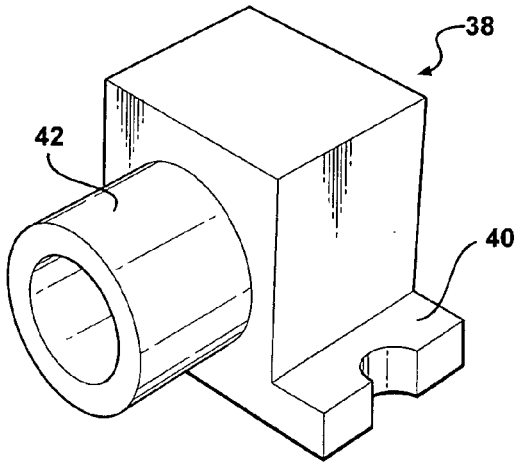
FIG - 9
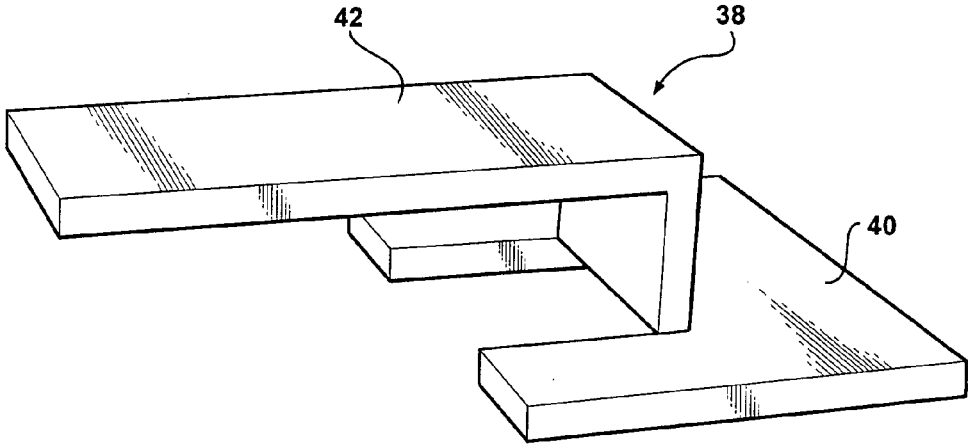

WINDOW PANE AND A METHOD OF BONDING A CONNECTOR TO THE WINDOW PANE

BACKGROUND OF THE INVENTION

1. Field of the Invention

The subject invention relates to window panes for vehicles and a method of bonding an electrical connector to an electrical conductor applied to the window pane.

2. Description of Related Art

Glass window panes for vehicles, such as windshields, backlites (rear windows), and side windows, frequently include electrical conductors applied to a glass substrate of the window pane. The electrical conductors are typically formed of a silver paste and include one or more pads with a number of leads extending from the pad. The electrical conductors can serve a number of purposes, such as heaters, radio or cellular phone antennas, or keyless entry circuits.

A connector is bonded to the pad to provide electrical communication between a device, such as a heater controller, radio, cell phone, etc., and the electrical conductors. The connector is adapted to receive an end of a wiring harness from the heater controller, radio, cell phone, etc. The connectors can be bonded to the pad by adhesives or can be soldered to the pad through the use of lead soldering techniques. As is known to those skilled in the art, lead soldering requires an external heating of the glass substrate which melts a lead solder and the connector to metallurgically bond the connector to the glass substrate. Traditionally, the connectors also include lead which minimizes mechanical stresses between the connector and the glass substrate during thermal expansion.

Although often effective, the prior art lead soldering is undesirable as lead is considered an environmental contaminant. The lead solder can also crack, which causes the connector to detach from the glass window. Further, the heating involved can cause cracking in the glass substrate.

The prior art has attempted to overcome the deficiencies with lead soldering by developing alternative techniques. One such alternative is disclosed in U.S. Pat. No. 5,735,446. The '446 patent utilizes a friction welding technique that rapidly rotates the connector and simultaneously applies pressure to the connector against the glass substrate. Portions of the connector and the conductor on the glass substrate melt and then re-solidify to create a metallurgical bond between the connector and the conductor. Although avoiding the issues with lead soldering, the friction welding technique of the '446 patent has a number of deficiencies. First, this rotating technique requires that the connector be symmetrical, which greatly reduces the design options for the connectors. Also, the melting of the connector and conductor is an undesirable affect in that the conductor can be completely removed from the glass substrate thereby creating a disconnect between the connector and conductor. Further, the rapid rotation and/or pressure can create undesirable mechanical and thermal shocks that could fracture the glass substrate.

Accordingly, it would be desirable to develop a method of bonding a connector to a conductor that eliminates the use of lead and avoids the deficiencies of the prior art methods.

SUMMARY OF THE INVENTION AND ADVANTAGES

The subject invention includes a method of bonding an electrical connector to an electrical conductor with the connector and conductor each having predefined melting points. The method comprises the step providing a glass substrate. The electrical conductor is deposited over a portion of the glass substrate. The connector is placed over the conductor. The connector is oscillated relative to the conductor to bond the connector to the conductor while maintaining the temperatures of the connector and conductor below the predefined melting points and without damaging the glass substrate.

The subject invention also includes a window pane for a vehicle. The window pane comprises the substrate formed from glass. The electrical conductor is coupled to the glass substrate. The electrical connector is bonded to the electrical conductor for transferring electrical energy to the conductor. An electrically conductive foil is disposed between the connector and the conductor for ensuring electrical communication between the connector and the conductor.

Accordingly, the subject invention sets forth a method of bonding a connector to a conductor that eliminates the use of lead and avoids the deficiencies of the prior art methods. Further, the subject invention includes a unique foil disposed between the connector and conductor to overcome additional deficiencies in the prior art.

BRIEF DESCRIPTION OF THE DRAWINGS

Other advantages of the present invention will be readily appreciated as the same becomes better understood by reference to the following detailed description when considered in connection with the accompanying drawings wherein:

FIG. 7 is a cross-sectional front view of the backlite, electrical conductor, and electrical connector with a ceramic layer disposed between the conductor and backlite;

FIG. 8 is a perspective view of an alternative connector;

FIG. 9 is perspective view of another alternative connector;

DETAILED DESCRIPTION OF THE INVENTION

Figure 1:
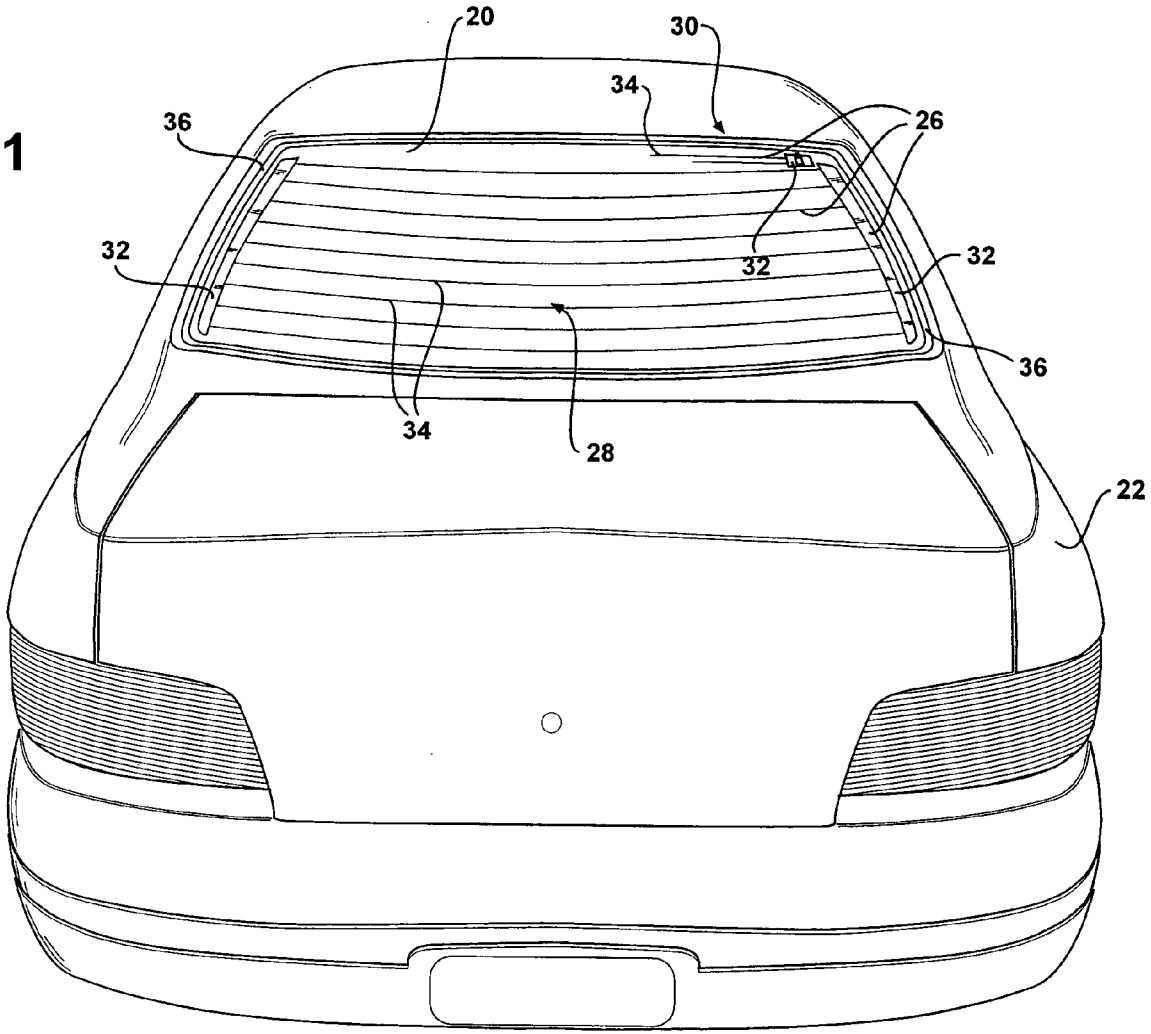
FIG. 1 is an exterior rear view of a vehicle illustrating a backlite with a number of electrical conductors disposed thereon.
Figure 2:
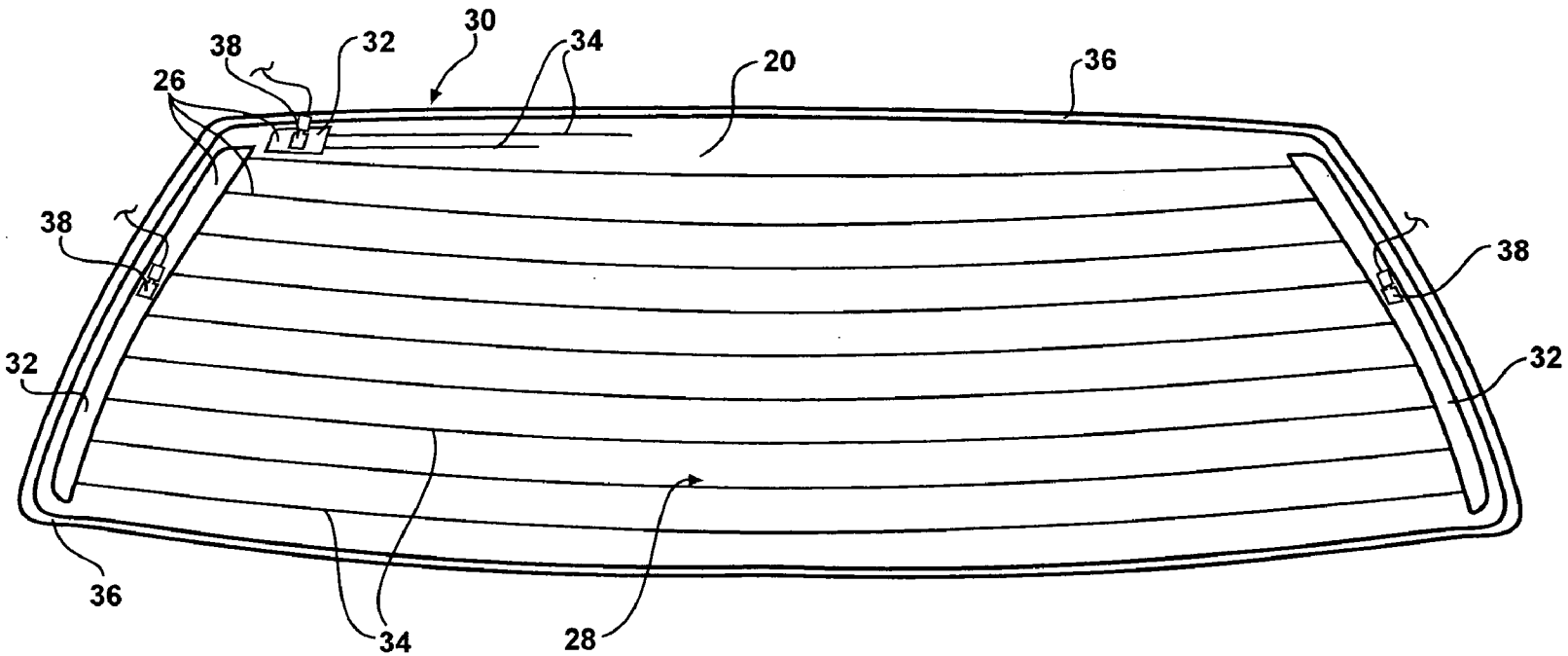
FIG. 2 is an interior view of the backlite.
Figure 3:
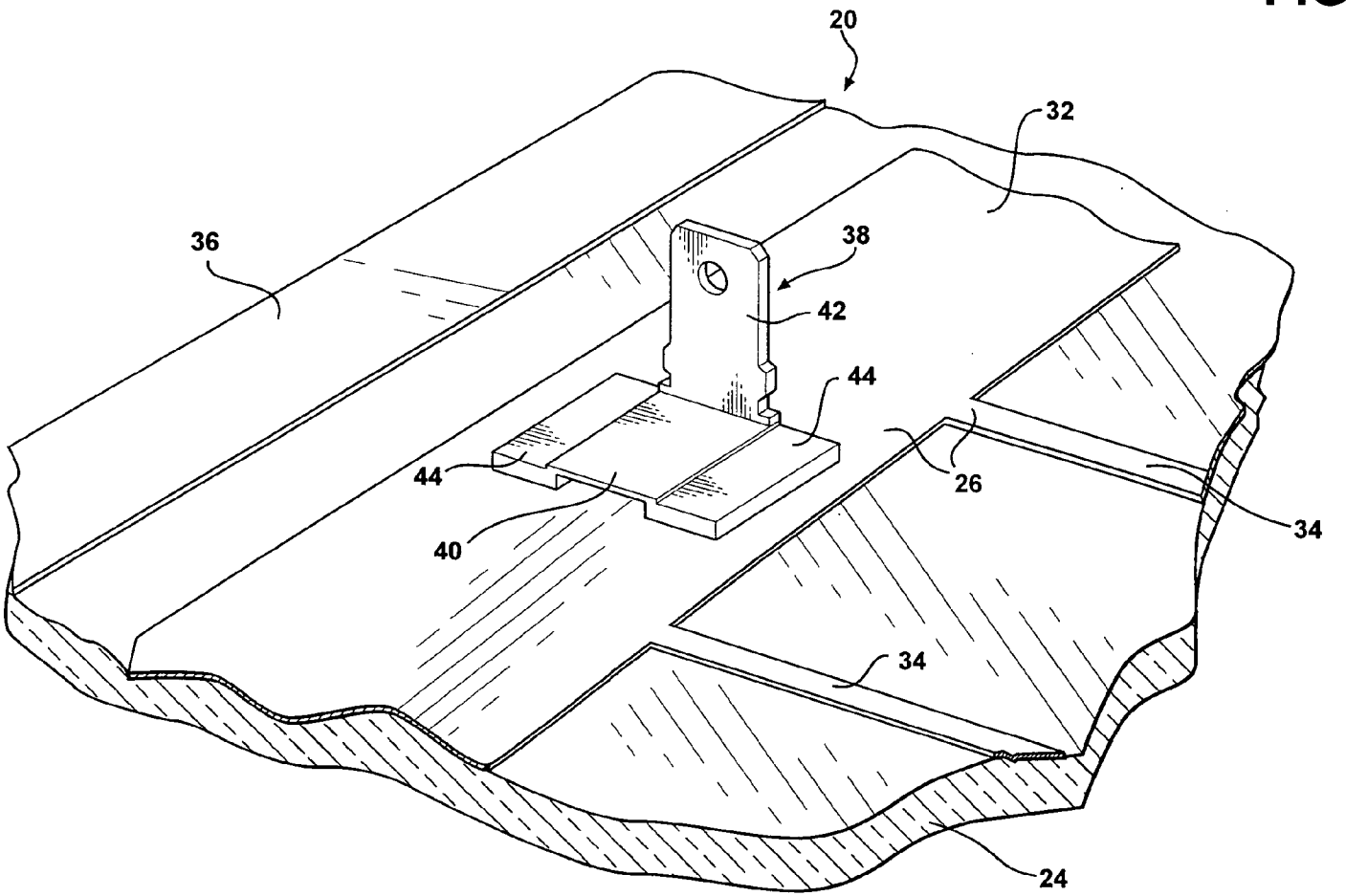
FIG. 3 is an enlarged perspective view of a portion of the backlite illustrating a portion of the electrical conductors with an electrical connector bonded thereto.
Figure 4:
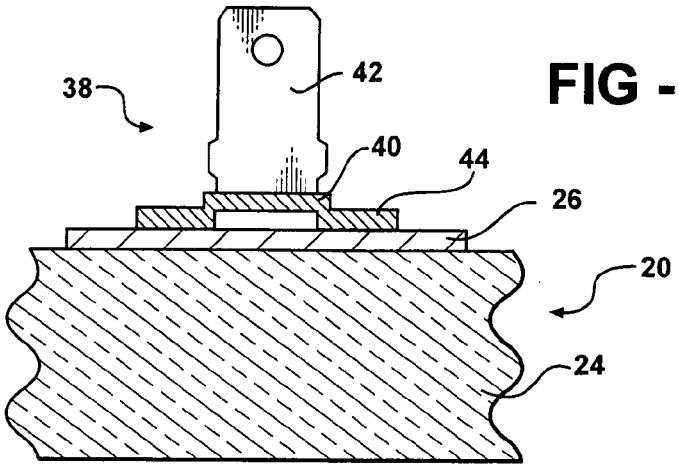
FIG. 4 is a cross-sectional front view of the backlite, electrical conductor, and electrical connector of FIG. 3.
Figure 5:
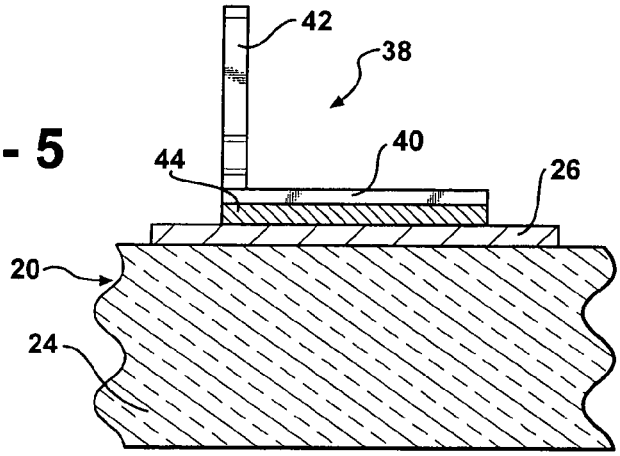
FIG. 5 is a cross-sectional side view of the backlite, electrical conductor, and electrical connector of FIG. 3.

Referring to the Figures, wherein like numerals indicate like or corresponding parts throughout the several views, a window pane 20 for a vehicle 22 is generally shown in FIGS. 1 and 2. The window pane 20 illustrated is a backlite (rear window) of the vehicle 22. As will become apparent, the subject invention can be equally incorporated into a windshield, side window, or any other window pane 20 in the vehicle 22. Referring also to FIGS. 3–5, the window pane 20 includes a substrate 24 formed from glass of any suitable composition. Preferably, the glass substrate 24 is further defined as an automotive glass. Even move preferably, the automotive glass is further defined as a soda-lime-silica glass.

As shown in FIGS. 1–5, the window pane 20 also includes an electrical conductor 26 coupled to the glass substrate 24. The electrical conductor 26 may be formed of any suitable material. Preferably, the electrical conductor 26 is formed of a silver paste and the silver paste is bonded directly to the glass substrate 24, which defines an electrical contact surface on the window pane 20. The thickness of the sliver paste can be from $5\times10^6$ m to $20\times10^6$ m and may also include other materials such as glass frit and flow modifiers. The electrical conductor 26 has a predefined melting point ranging from 800° C. to 1000° C.

The electrical conductor 26 can be applied as a continuous uninterrupted grid of silver paste 28 over a region of the glass substrate 24. The grid of silver paste 28 can define a heater, such as shown in FIGS. 1 and 2. Further, the electrical conductor 26 can be applied as a continuous uninterrupted path of silver paste 30 over a region of the glass substrate 24. The path of silver paste 30 can define a radio or cellular phone antenna, such as shown in FIGS. 1 and 2, or a keyless entry circuit. As illustrated, the grid of silver paste 28 and path of silver paste 30 may be applied to the same window pane 20. Alternatively, the grid 28 and path 30 of silver paste could be applied to different window panes 20 of the vehicle 22. Further, it should be appreciated that the electrical conductor 26 may be formed of any suitable type of silver or non-silver conductive paste without deviating from the overall scope of the subject invention.

The electrical conductor 26, whether patterned in a grid 28 or a path 30, includes at least one pad 32 and a plurality of leads 34 extending from the pad 32. The pad 32 operates as a bus bar for receiving electrical current and passing the electrical current to the leads 34. The electrical conductor 26 patterned as a grid 28 typically includes a pair of pads 32 with the plurality of leads 34 extending between the pads 32 to continuously transfer electrical current, i.e., heat, between the pads 32. The electrical conductor 26 patterned as a path 30 typically includes a single pad 32 with one or more leads 34 extending away from the pad 32 to transfer electrical current, i.e., electrical signals, from outside the vehicle 22 to the pad 32. The leads 34 of either pattern may be interconnected or may be of any suitable pattern to provide the required transfer of electrical current.

As shown in FIGS. 1–3 and 7, a ceramic layer 36 may also be bonded directly to the glass substrate 24. As known to those skilled in the art, the ceramic layer 36 is generally black in color and is typically formed about a periphery of the window pane 20. The ceramic layer 36 protects an adhesive on the glass substrate 24 from UV degradation. As also known in the art, such adhesive is used to adhere the window pane 20 to the vehicle 22. As shown in FIG. 7, the electrical conductor 26 may alternatively be applied directly to the ceramic layer 36. As such, the grid 28 and/or path 30 of silver paste may be applied to the ceramic layer 36.

As shown in FIGS. 1–7, an electrical connector 38 is coupled to the electrical conductor 26 for transferring electrical energy to the conductor 26. The electrical connector 38 includes a base portion 40 and a coupling portion 42. The base portion 40 includes a contact surface that bonds with the electrical contact surface of the electrical conductor 26. The coupling portion 42 is preferably positioned on the base portion 40 to define a non-symmetrical connector 38. The non-symmetrical nature of the connector 38 allows for greater diversity in designing the connector 38. The electrical connector 38 has predefined melting point ranging from 1050° C. to 1700° C. depending upon the material utilized. The melting point of the electrical connector 38 is greater than the melting point of the conductor 26.

In the embodiment shown in FIGS. 1–5, the base portion 40 of the connector 38 has a pair of legs 44 further defining the contact surface of the connector 38. The legs 44 are bonded directly to the electrical contact surface of the electrical conductor 26. The relative size and thickness of the legs 44 can be modified as desired. The coupling portion 42 is preferably configured as a spear to receive an end of a wiring harness from a heater controller, radio, cell phone, etc (not shown).

As shown in FIGS. 1–3, the connector 38 is bonded to the pad 32 of the conductor 26, which is preferably adjacent the periphery of the window pane 20. The conductor 26 patterned in a grid 28 can include a pair of connectors 38, one on each pad 32. Hence, an electrical current or electrical energy passes from the vehicle 22, into one of the connectors 38, through the associated pad 32 and along the leads 34. The current or energy then passes into the opposing pad 32, through the opposing connector 38 and returns to the vehicle 22 to complete an electrical circuit.

The electrical connector 38 preferably comprises at least one of titanium, molybdenum, tungsten, hafnium, tantalum, chromium, iridium, niobium, and vanadium. The electrical connector 38 may also comprise at least one of silver, copper, gold, aluminum, and nickel. Even more preferably, the electrical connector 38 comprises titanium, which defines the melting point of the electrical connector 38 as 1668° C. The titanium connector 38 may be alloyed with a metal selected from the group of aluminum, tin, copper, molybdenum, cobalt, nickel, zirconium, vanadium, chromium, niobium, tantalum, palladium, ruthenium, and combinations thereof. In essence, the connector 38 is preferably free of lead to minimize environmental contamination. The details and uniqueness of a window pane 20 having a titanium electrical connector 38 coupled to an electrical conductor 26 are disclosed and claimed in co-pending U.S. patent application Ser. No. 10/988,350 and as such will not be discussed in any greater detail.

Figure 6:
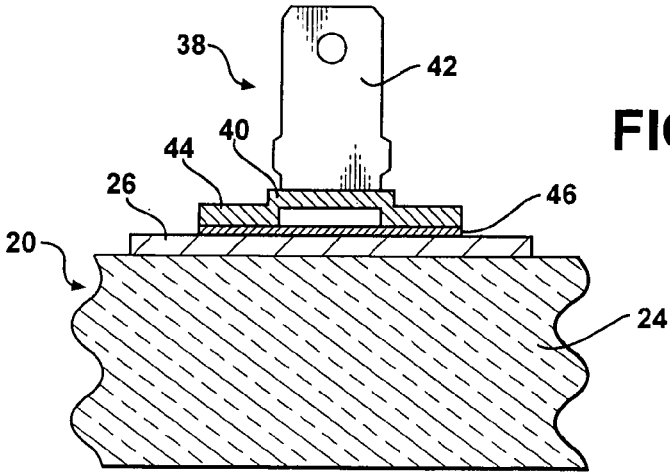
FIG. 6 is a cross-sectional front view of the backlite, electrical conductor, and electrical connector with a conductive foil disposed between the connector and conductor.

As shown in FIG. 6, an electrically conductive foil 46 can be disposed between the connector 38 and the conductor 26 to bond the connector 38 to the conductor 26 for ensuring electrical communication between the connector 38 and the conductor 26. The foil 46 is particularly useful when the electrical connector 38 is formed of titanium. Preferably, the electrically conductive foil 46 is formed of aluminum.

FIG. 7 illustrates the electrical connector 38 being bonded directly to the conductor 26 with the conductor 26 in turn being bonded to the ceramic layer 36. The ceramic layer 36 is bonded directly to the glass substrate 24. The alternative configuration of FIG. 7 does not materially alter the design or uniqueness of the subject invention.

FIGS. 8 and 9 illustrate alternative configurations of the connector 38. In particular, FIG. 8 discloses a coaxial coupling portion 42 and FIG. 9 discloses a flat base portion 40 with a parallel spear for the coupling portion 42. Again, these configurations illustrate various possibilities of non-symmetrical connectors 38.

Referring now to FIGS. 10–14, a method of bonding the electrical connector 38 to the electrical conductor 26 is disclosed. Initially, the glass substrate 24 is provided. As mentioned above, the glass substrate 24 is preferably formed of a soda-lime-silica glass.

The electrical conductor 26 is then deposited over a portion of the glass substrate 24. In one configuration, the electrical conductor 26 is deposited in a continuous uninterrupted grid 28 of electrically conductive material over a portion of the glass substrate 24. Preferably, as mentioned above, the material is a silver paste. Hence, the step of depositing the electrical conductor 26 is further defined as depositing a continuous uninterrupted grid of silver paste 28 onto the glass substrate 24. In another configuration, the electrical conductor 26 is depositing a continuous uninterrupted path 30 of electrically conductive material over a portion of the glass substrate 24. Preferably, the material is the silver paste such that the step of depositing the electrical conductor 26 is further defined as depositing a continuous uninterrupted path of silver paste 30 onto the glass substrate 24. The silver paste may be bonded to the glass substrate 24 by any suitable technique, such as a sintering process.

A ceramic layer 36 may also be applied to the glass substrate 24. In an alternative embodiment, the ceramic layer 36 is first applied to the glass substrate 24 through any known technique. The step of depositing the conductor 26 over a portion of the glass substrate 24 is then defined as depositing the conductor 26 onto the ceramic layer 36. This configuration is shown in FIG. 7.

Figure 10:
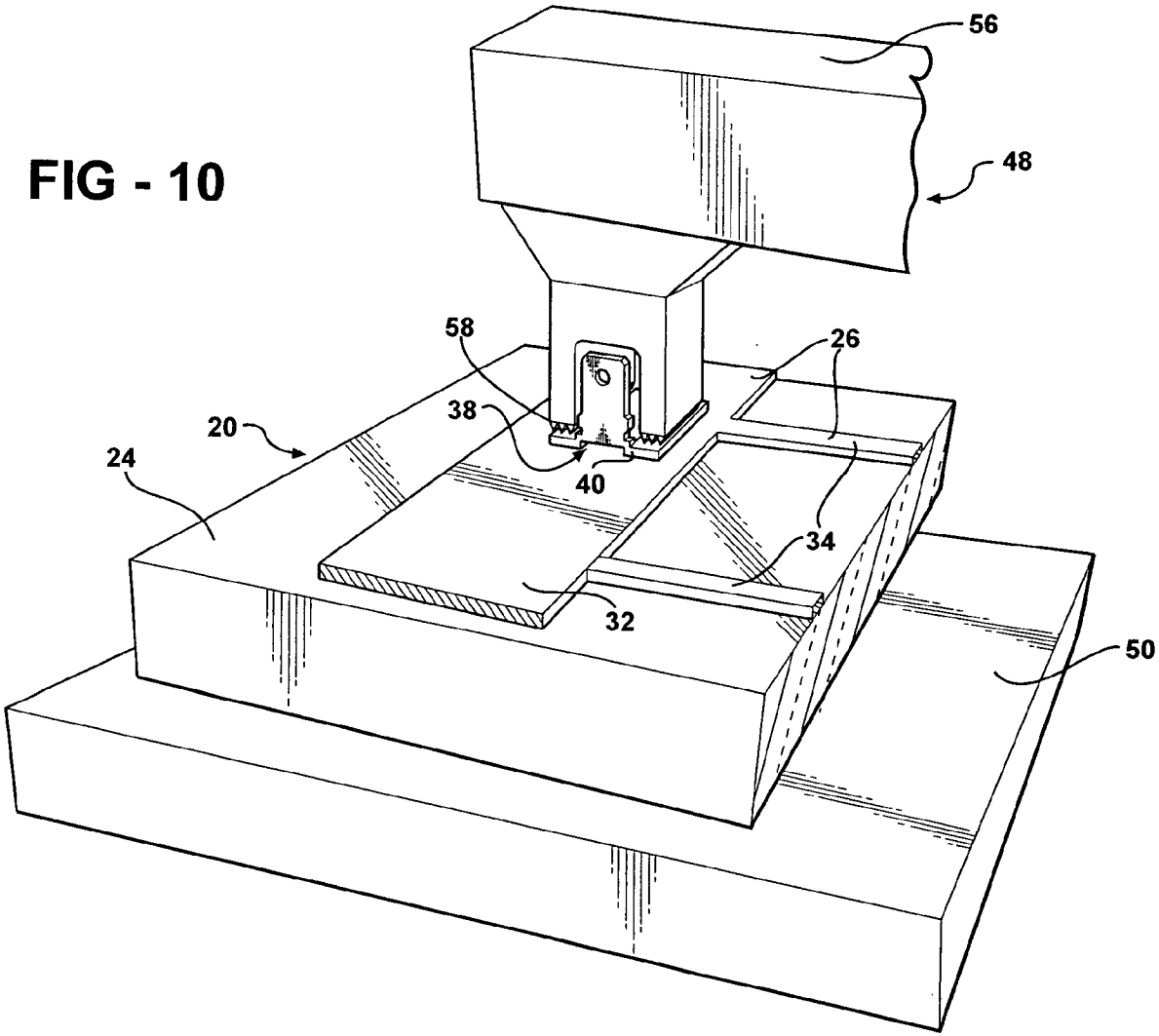
FIG. 10 is perspective view of an ultrasonic welding apparatus for bonding the connector to the conductor.
Figure 11:
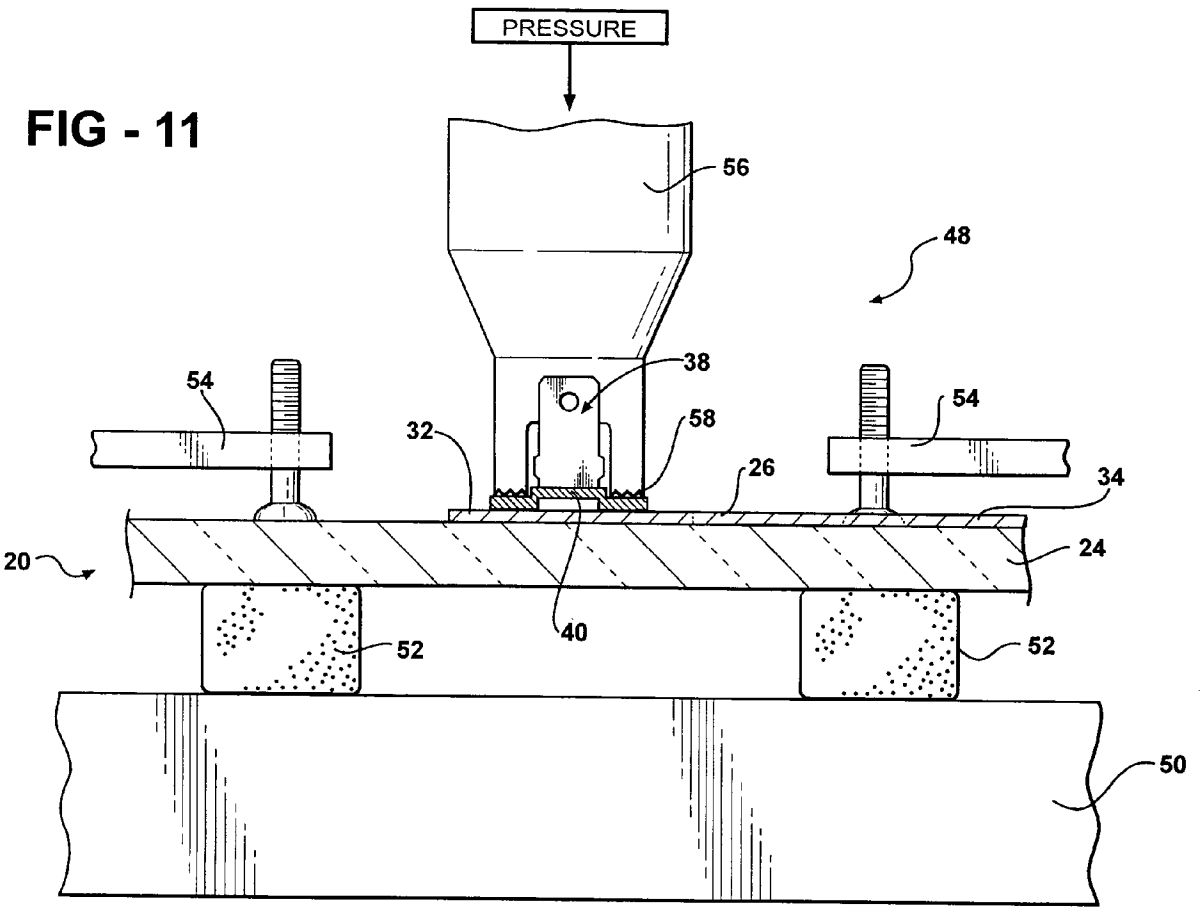
FIG. 11 is a front view of the ultrasonic welding apparatus.
Figure 12:
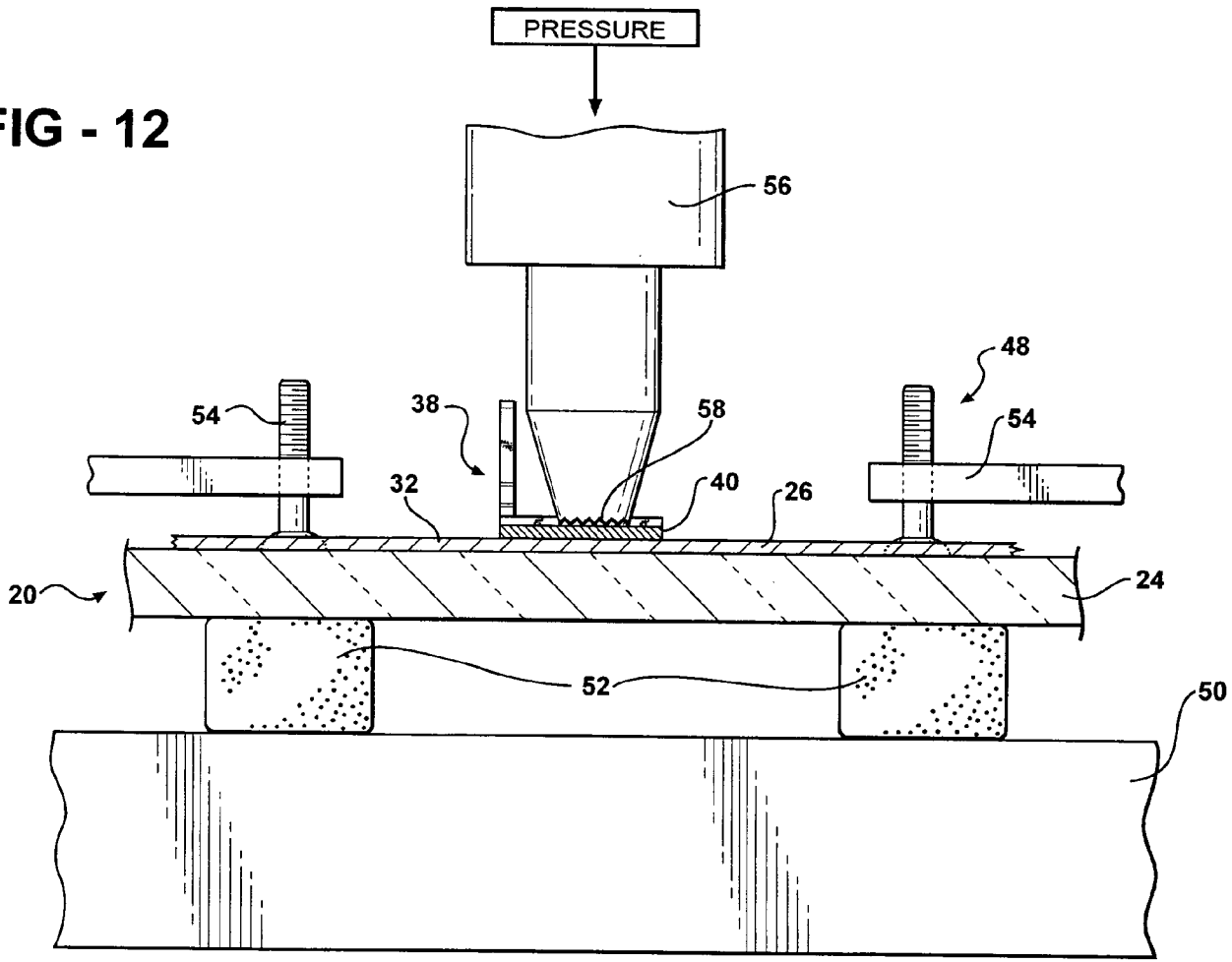
FIG. 12 is a side view of the ultrasonic welding apparatus.

Once the conductor 26 is applied to either the glass substrate 24 or the ceramic layer 36, the connector 38 is then place over the conductor 26. In one embodiment, the connector 38 directly abuts the conductor 26. This embodiment of the connector 38 is shown in FIGS. 10–12, wherein the legs 44 of the base portion 40 directly abut one of the pads 32 of the conductor 26. As mentioned above, the conductor 26 in turn may be directly connected to the glass substrate 24 or may be coupled to the glass substrate 24 through the ceramic layer 36.

The preferred method of bonding the connector 38 to the conductor 26 oscillates the connector 38 relative to the conductor 26 thereby creating shearing forces between he connector 38 and conductor 26. The connector 38 is then bonded to the conductor 26 while maintaining the temperatures of the connector 38 and conductor 26 below the predefined melting points and without damaging the glass substrate 24. Only a moderate temperature increase occurs at the juncture of the connector 38 and conductor 26. Accordingly, the preferred method minimizes mechanical and thermal shocks experienced by the glass substrate 24.

Preferably, the connector 38 is oscillated in a direction parallel to the glass substrate 24. Further, the connector 38 is preferably oscillated at a relatively high frequency from 20 kHz to 40 kHz and at an amplitude of $18\times10^{6}$ m to $50\times10^{6}$ m. Most preferably, the connector 38 is oscillated at a frequency of 20 kHz. A force is also applied to the connector 38 against the conductor 26 during the step of oscillating the connector 38 relative to the conductor 26. In particular, the force ranges from 85 to 2,300 Newtons and is applied to the connector 38. Depending upon the size of the connector 38 and the amount of pressure applied to the connector 38, a pressure of 3 to 90 MPa is applied to the connector 38. Preferably, the steps of oscillating the connector 38 and applying the pressure to the connector 38 are preformed simultaneously for less than 1 second. Taking into consideration the variables above, the total energy input to an interface of the connector and the conductor ranges from 0.25 to 5 J/mm$^2$.

The glass substrate 24 is preferably mounted before the step of oscillating the connector 38 such that the glass substrate 24 and conductor 26 remain stationary during the step of oscillating the connector 38 relative to the conductor 26. The above operation of oscillating and applying pressure to the connector 38 relative to the conductor 26 can be adequately accomplished through the use of an ultrasonic welding apparatus 48, which are known to those skilled in the art.

A schematic depiction of the ultrasonic welding apparatus 48 is shown in FIGS. 10–12. The ultrasonic welding apparatus 48 includes an anvil 50 for supporting the glass substrate 24. As shown in FIGS. 11 and 12, damping pads 52 are positioned between the anvil 50 and a bottom of the glass substrate 24 and clamps 54 are disposed on a top of the glass substrate 24. Hence, the glass substrate 24 is fixedly mounted during the oscillation process. A hammer 56 abuts the connector 38. In particular, the hammer 56 includes a rough contact surface 58 that abuts the base portion 40 of the connector 38. The hammer 56 oscillates horizontally, i.e. parallel to the glass substrate 24, and applies the desired pressure. The connector 38 then oscillates rapidly, at the above mentioned high-frequencies, relative to the conductor 26.

Figure 13:
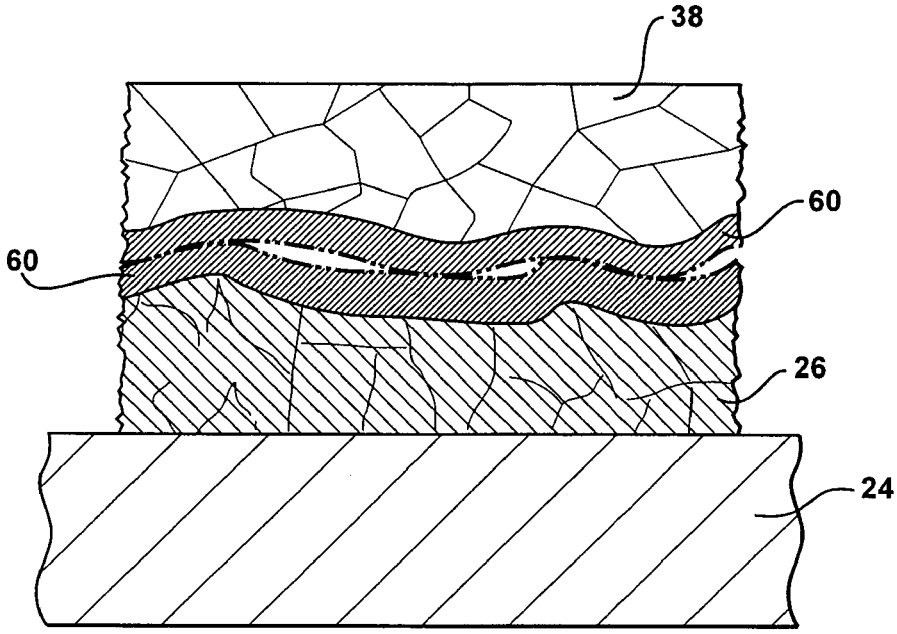
FIG. 13 is a microscopic view of the contact surfaces of the connector and conductor before the connector is bonded to the conductor.
Figure 14:
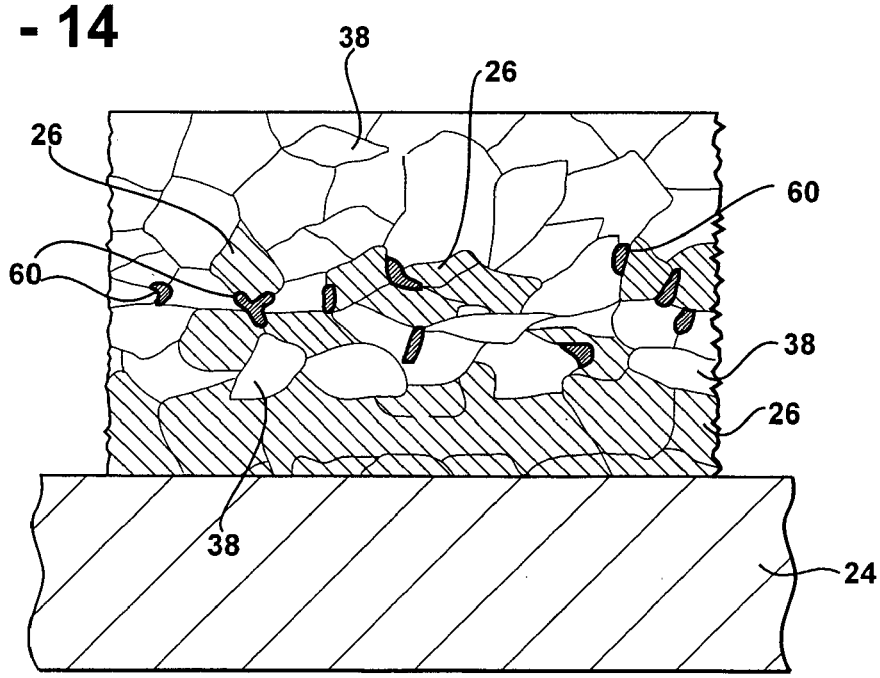
FIG. 14 is a microscopic view of the contact surfaces of the connector and conductor after the connector is bonded to the conductor.

As illustrated in FIGS. 13 and 14, the rapid oscillation of the connector 38 relative to the conductor 26 disperses a portion of the contact surfaces of the connector 38 and conductor 26 to create a metallurgical bond, as opposed to a chemical bond, between the connector 38 and conductor 26. In particular, the contact surfaces of the connector 38 and conductor 26 are further defined as oxide layers 60, shown intact in FIG. 13. A portion of the oxide layers 60 are disrupted and dispersed to create the metallurgical bond between the connector 38 and conductor 26 as shown in FIG. 14. In fact, there is an atomic diffusion at the contact surfaces and the connector 38 and conductor 26 re-crystallize into a fine grain structure having the properties of a cold-worked metal. Due to the dispersion of the oxide layers 60, it is not necessary to pre-clean the connector 38 and conductor 26. Metallurgical bonds are important to maintain electrical conductivity such that electrical current can flow between the connector 38 and the conductor 26. Those skilled in the art appreciate that chemical bonds can increase resistively of the connection between the connector 38 and the conductor 26, and therefore inhibit the flow of the electrical current.

As discussed above, the ultrasonic welding process of the subject invention is effective in reducing the mechanical and thermal shocks experienced by the glass substrate 24. In order to further reduce the likelihood of a damaging thermal shock to the glass substrate 24 during the oscillation, the method can further include the step of heating the glass substrate 24 to an elevated temperature before the step of oscillating the connector 38. Further, the glass substrate 24 would preferably be at the elevated temperature during the step of oscillating the connector 38. The glass substrate 24 is preferably heated to an elevated temperature of 100 degrees to 250 degrees Celsius. The pre-heated glass substrate 24 can then be air cooled.

As illustrated in FIG. 6, the electrically conductive foil 46 layer can be applied in-between the connector 38 and conductor 26 before the step of oscillating the connector 38. As discussed above, the foil 46 layer can assist in the bonding of the connector 38 to the conductor 26, especially if the connector 38 is formed of titanium.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A method of bonding an electrical connector to an electrical conductor with the connector and conductor each having predefined melting points, said method comprising the steps of:

providing a glass substrate;

depositing the electrical conductor over a portion of the glass substrate;

placing the connector over the conductor;

oscillating the connector relative to the conductor to bond the connector to the conductor while maintaining the temperatures of the connector and conductor below the predefined melting points and without damaging the glass substrate; and heating the glass substrate to an elevated temperature before the step of oscillating the connector and oscillating the connector while the glass substrate is at the elevated temperature.

2. A method as set forth in claim 1 wherein the step of heating the glass substrate is further defined as heating the glass substrate to an elevated temperature of 100 degrees to 250 degrees Celsius.

3. A method as set forth in claim 1 further including the step of applying an electrically conductive foil layer in-between the connector and conductor before the step of oscillating the connector.

4. A method as set forth in claim 1 further including the step of applying a ceramic layer to the glass substrate.

5. A method as set forth in claim 4 wherein the step of depositing the conductor over a portion of the glass substrate is further defined as depositing the conductor onto the ceramic layer.

6. A method as set forth in claim 1 further including the step of mounting the glass substrate before the step of oscillating the connector such that the glass substrate and conductor remain stationary during the step of oscillating the connector relative to the conductor.

7. A method as set forth in claim 6 wherein the step of oscillating the connector is further defined as oscillating the connector in a direction parallel to the glass substrate.

8. A method as set forth in claim 7 wherein the step of oscillating the connector is further defined as oscillating the connector at a frequency from 20 kHz to 40 kHz.

9. A method as set forth in claim 8 wherein the step of oscillating the connector is further defined as oscillating the connector at a frequency of 20 kHz.

10. A method as set forth in claim 1 further including the step of applying pressure on the connector against the conductor during the step of oscillating the connector relative to the conductor.

11. A method as set forth in claim 10 wherein the step of applying pressure on the connector is further defined as applying a force ranging from 85 to 2,300 Newtons to the connector.

12. A method as set forth in claim 11 wherein the step of applying pressure on the connector is further defined as applying a pressure of 3 to 90 MPa depending upon a size of the connector and the force applied to the connector.

13. A method as set forth in claim 12 wherein the steps of oscillating the connector and applying pressure on the connector are preformed simultaneously for less than 1 second.

14. A method as set forth in claim 13 further including the step of applying a total energy input at an interface of the connector and the conductor ranging from 0.25 to 5 $J/mm^2$.

15. A method as set forth in claim 1 wherein each of the connector and conductor include a contact surface and wherein the step of oscillating the connector to bond the connector to the conductor is further defined as dispersing a portion of the contact surfaces of the connector and conductor to create a metallurgical bond between the connector and conductor.

16. A method as set forth in claim 15 wherein the contact surfaces of the connector and conductor are further defined as oxide layers and wherein the step of oscillating the connector to bond the connector to the conductor is further defined as dispersing a portion of the oxide layers to create a metallurgical bond between the connector and conductor.

17. A method as set forth in claim 1 further including the step of forming the glass substrate.

18. A method as set forth in claim 1 wherein the step of depositing the electrical conductor over a portion of the glass substrate is further defined as depositing a continuous uninterrupted grid of electrically conductive material over a portion of the glass substrate.

19. A method as set forth in claim 18 wherein the material is a silver paste and wherein the step of depositing the electrical conductor is further defined as depositing a continuous uninterrupted grid of silver paste onto the glass substrate.

20. A method as set forth in claim 1 wherein the step of depositing the electrical conductor over a portion of the glass substrate is further defined as depositing a continuous uninterrupted path of electrically conductive material over a portion of the glass substrate.

21. A method as set forth in claim 20 wherein the material is a silver paste and wherein the step of depositing the electrical conductor is further defined as depositing a continuous uninterrupted path of silver paste onto the glass substrate.

22. A method of bonding an electrical connector to an electrical conductor with the connector and conductor each having predefined melting points, said method comprising the steps of:

providing a glass substrate;

depositing the electrical conductor over a portion of the glass substrate;

placing the connector over the conductor;

oscillating the connector relative to the conductor to bond the connector to the conductor while maintaining the temperatures of the connector and conductor below the predefined melting points and without damaging the glass substrate; and applying an electrically conductive foil layer in-between the connector and conductor before the step of oscillating the connector.

23. A method as set forth in claim 22 further including the steps of heating the glass substrate to an elevated temperature before the step of oscillating the connector and oscillating the connector while the glass substrate is at the elevated temperature.

24. A method as set forth in claim 23 wherein the step of heating the glass substrate is further defined as heating the glass substrate to an elevated temperature of 100 degrees to 250 degrees Celsius.

25. A method as set forth in claim 22 further including the step of applying a ceramic layer to the glass substrate.

26. A method as set forth in claim 25 wherein the step of depositing the conductor over a portion of the glass substrate is further defined as depositing the conductor onto the ceramic layer.

27. A method as set forth in claim 22 further including the step of applying pressure on the connector against the conductor during the step of oscillating the connector relative to the conductor and wherein the steps of oscillating the connector and applying pressure on the connector are preformed simultaneously for less than 1 second.

28. A method as set forth in claim 27 further including the step of applying a total energy input at an interface of the connector and the conductor ranging from 0.25 to 5 $J/mm^2$.

* * * * *